US006346041B1

(12) United States Patent
Desmond et al.

(10) Patent No.: US 6,346,041 B1
(45) Date of Patent: Feb. 12, 2002

(54) ECONOMIZER

(75) Inventors: John S. Desmond, Concord; Rumen N. Raykov, Belmont, both of MA (US); Benjamin J. Kalinowski, Newton, NH (US); Richard J. Rummo, Amesbury, MA (US); Brett E. O'Brien, Plymouth, MA (US); William J. Cleary, Woburn, MA (US); Darrell M. Kohr, Pembroke, MA (US)

(73) Assignee: Cox Engineering Company, Inc., Canton, MA (US)

( * ) Notice: Subject to any disclaimer, the term of this patent is extended or adjusted under 35 U.S.C. 154(b) by 0 days.

(21) Appl. No.: 09/498,402

(22) Filed: Feb. 4, 2000

(51) Int. Cl.[7] ..... F24F 13/04
(52) U.S. Cl. ..... 454/268; 454/236
(58) Field of Search ..... 454/268, 261, 454/269, 264, 324, 234, 236; 137/901, 864

(56) References Cited

U.S. PATENT DOCUMENTS

| | | | | | |
|---|---|---|---|---|---|
| 4,078,576 | A | * | 3/1978 | Punch et al. | 137/604 |
| 5,197,920 | A | * | 3/1993 | Ganse | 454/228 |
| 5,632,675 | A | * | 5/1997 | Kanninen et al. | 454/264 |
| 5,645,481 | A | * | 7/1997 | Robinson et al. | 454/261 |

OTHER PUBLICATIONS

Technical Sheet, Honeywell, Inc, Solid State Economizer, pp. 1–16, Nov. 1997.
Technical Sheet, Honeywell, Inc, Solid State Economizer, pp. 1–20, Jan. 1997.
Technical Sheet, Honeywell, Inc, Solid State Enthalpy Sensor, pp. 1–6, Jan. 1997.
Technical Sheet, Honeywell, Inc, Solid State Economizer, Logic Module, pp. 1–20, Dec., 1997.
Technical Sheet, Carrier Corporation, Economizer, pp. 1–4, 1999.
Technical Sheet, Carrier Corporation, Single–Package Rooftop Units Electric Cooling/Gas Heating, pp. 1–8, 1999.
Technical Sheet, MicroMetl Corporation, Convertible Economizers, pp. 1–8, 1999.

* cited by examiner

*Primary Examiner*—Harold Joyce
*Assistant Examiner*—Derek S. Boles
(74) *Attorney, Agent, or Firm*—Steven N. Fox, Esq.

(57) ABSTRACT

The present invention is an economizer that is capable of mixing outside air and inside air while incurring a significantly low pressure drop across the return air damper. In one embodiment, the economizer comprises a mixing chamber, a return air vent, and an outside air vent. The economizer further comprises a plurality of curved return air dampers moveable from an open position to a closed position to control the flow of return air to the mixing chamber. The economizer further comprises a plurality of straight dampers moveable from an open position to a closed position to control the flow of outside air to the mixing chamber. During operation of the economizer, a significantly lower pressure drop exists across the curved return air dampers than in conventional economizers thereby reducing the amount of energy needed to operate fans to maintain the desired air flow.

4 Claims, 4 Drawing Sheets

ECONOMIZER

FIELD OF THE INVENTION

The present invention relates generally to air handling systems. More particularly, the present invention relates to an economizer.

BACKGROUND OF THE INVENTION

Air handling systems are widely used to condition and distribute air within an internal space such as a commercial building. FIG. 1 shows a cross-section view of a conventional air handling system 10 mounted on a roof 12 having as a component an economizer 14 positioned upstream of air handling unit components 22. By way of example, the air handling unit components 22 may include components such as a cooling coil, a heating coil, and/or a fan, all of which are costly to operate.

Generally, the economizer 14 consists of a return air vent 18 in communication with an internal space 20, an outside air vent 22 in communication with the outside environment 24, and a mixing chamber 26. The return air vent 18 is in communication with the mixing chamber 26 by two straight dampers 28 which open and close thru a maximum angular rotation of 45 degrees to control the flow of return air into the mixing chamber 26. Similarly, the outside air vent 22 is in communication with the mixing chamber 26 by two straight dampers 30 which open and close to control the flow of outside air to the mixing chamber 26. Depending upon one or more the characteristics of the outside air (i.e, temperature, humidity, etc.) and desired characteristics of the supply air, the straight dampers 28 and 30 are synchronously moved by a control mechanism moved (not shown) to provide an optimum mixture of return air and outside air in the mixing chamber 20 which minimizes the operation of the air handling unit components 22 and the energy costs incurred therewith.

Conventional economizers of the type exemplified by FIG. 1 have several drawbacks. Movement and final position of the straight dampers 28 cause an excessive pressure drop across the straight damper 28, thereby increasing the amount of energy needed to operate the second stage conditioning system 16 and/or the air handling system 10.

OBJECTS OF THE INVENTION

One object of the present invention is to provide an economizer that has a significantly lower pressure drop across the return air vent when mixing return air and outside air.

SUMMARY OF THE PRESENT INVENTION

The present invention is an economizer that can mix outside air and return air while incurring a significantly low pressure drop across the return air damper than conventional devices. In one embodiment, the economizer comprises a mixing chamber, a return air vent, and an outside air vent. The economizer further comprises a plurality of curved return air dampers moveable from an open position to a closed position to control the flow of return air to the mixing chamber. The economizer further comprises a plurality of straight dampers moveable from an open position to a closed position to control the flow of outside air to the mixing chamber. During operation of the economizer, a significantly lower pressure drop exists across the curved return air dampers than in conventional economizers. When used in connection with commercial buildings, for example, the economizer of the present invention significantly reduces energy consumption associated with the operation of the overall air handing system which results in significant cost savings to the commercial customer.

BRIEF DESCRIPTION OF THE DRAWINGS

The following detailed description of the invention will be better understood with reference to the accompany drawings in which.

DETAILED DESCRIPTION OF THE PREFERRED EMBODIMENTS

Figure 1:
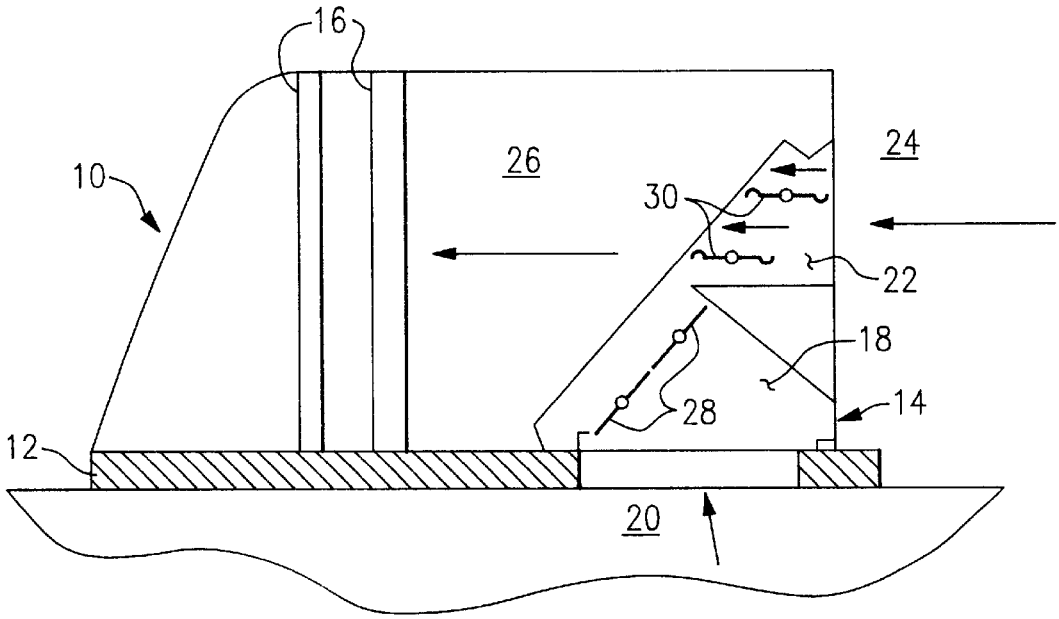
FIG.1 Prior Art
FIG. 1 is a cross section view of a conventional economizer.
Figure 2:
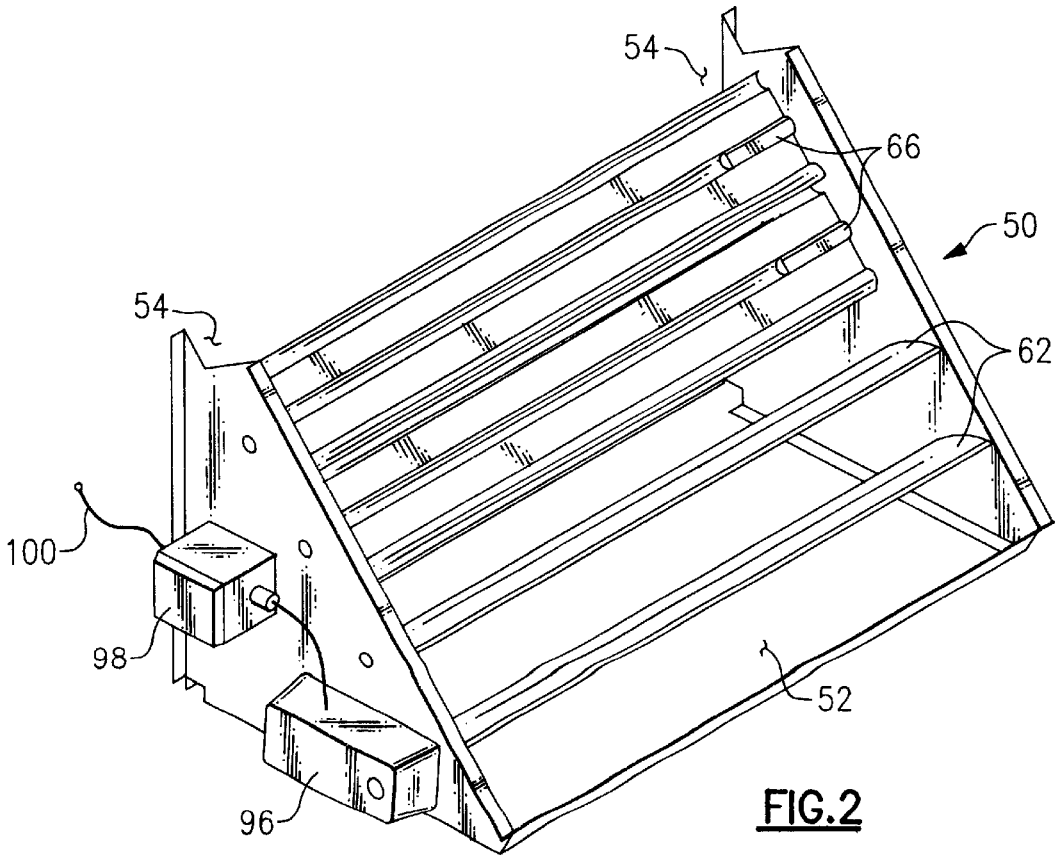
FIG. 2 is a perspective view of the present invention.
Figure 3:
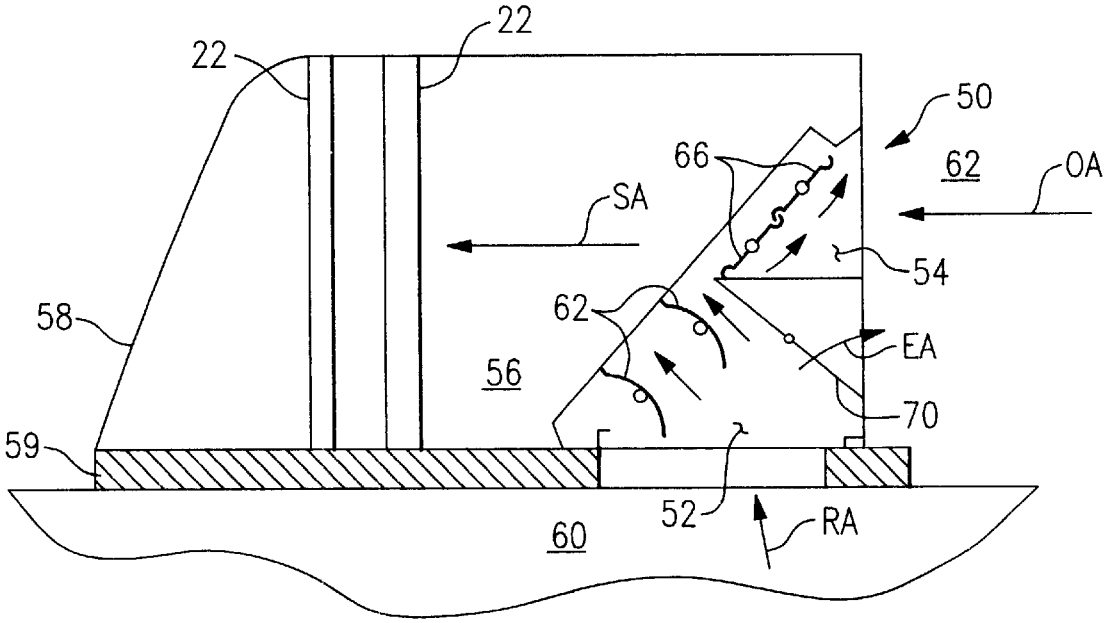
FIG. 3 is a cross-section of the present invention showing the position of the curved dampers of the return air vent and the straight dampers of the outside air vent when the air handling system is not operating.
Figure 4:
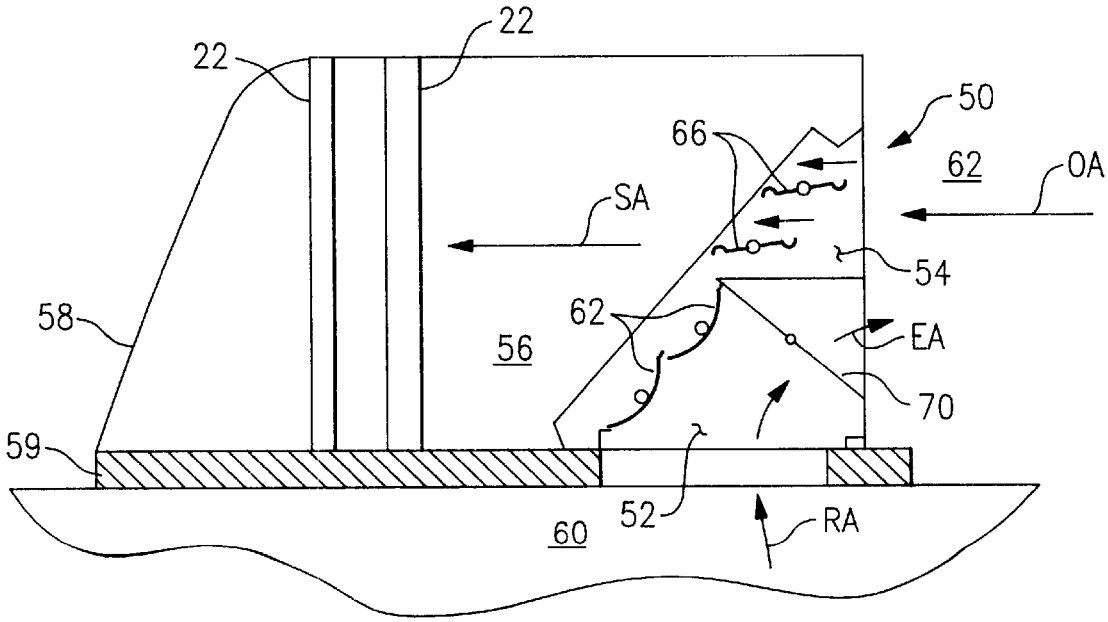
FIG. 4 is a cross-section of the present invention showing the position of the curved return air dampers and the straight outside air dampers when the air handling system is operating and the curved dampers and straight dampers are modulated to a given position within its range of modulation.

Referring to FIGS. 2–4, wherein one embodiment of the economizer 50 of the present invention is generally shown comprising a return air vent 52, an outside air vent 54, a mixing chamber 56. The economizer 50 is shown disposed within a conventional air handling system 58 mounted upon, for example, a roof 59 and a having for example, one or more air handling components 22 placed upstream of the economizer 50.

The return air vent 52 is in communication with an internal space 60 and the mixing chamber 56. The flow of return air (RA) from the internal space 60 into the mixing chamber 56 is controlled by the modulation and positioning of curved dampers 62.

The outside air vent 54 is in communication with the outside environment 64 and the mixing chamber 56. The flow of outside air (OA) from the outside environment 64 into the mixing chamber 56 is controlled by the modulation and positioning of straight dampers 66.

The economizer 50 further comprises an exhaust vent 70 in communication with the internal space 60 and the outside environment 62. The exhaust vent 70 may take a variety of designs such as a gravity hinged vent.

Figure 6:
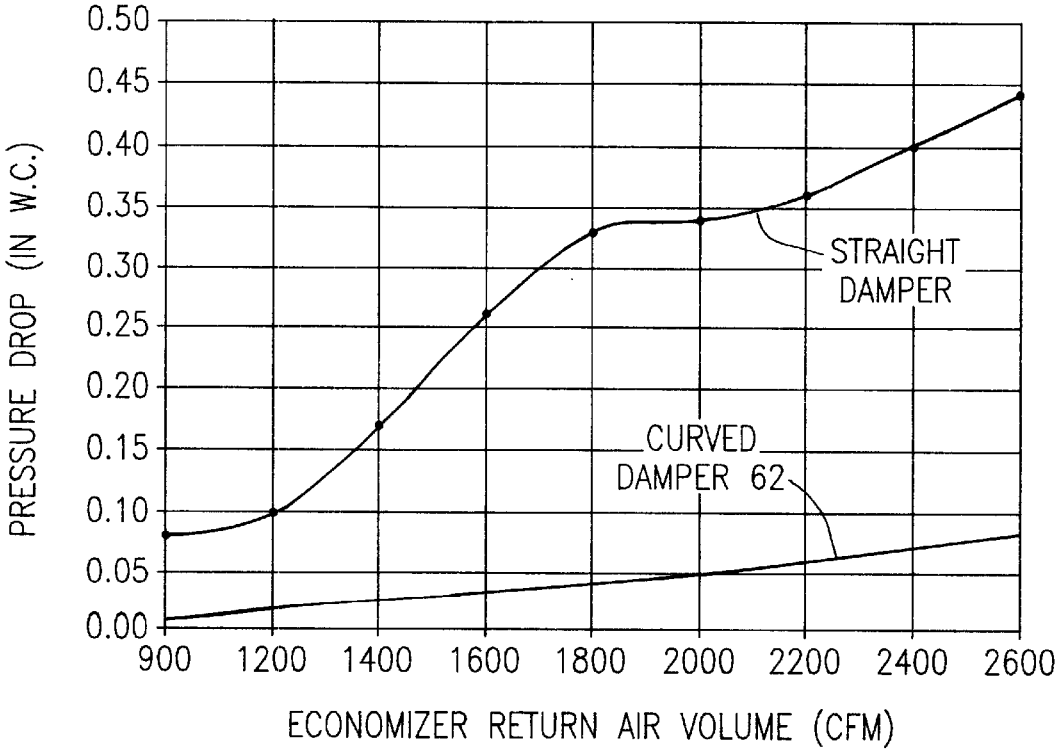
FIG. 6 is a graph showing that the curved dampers of the present invention incur significantly lower pressure drops than conventional straight dampers at a wide range of air flow rates.

During Idle and Operational Mode, a significantly low pressure drop occurs across the curved dampers 62. FIG. 6 shows a graph comparing pressure drop across the curved air dampers 62 verus the pressure drop across conventional straight air dampers: The data of FIG. 6 is summarized below:

| Air Flow (cfm) | Pressure Drop (w.c.) Straight Dampers | Pressure Drop (w.c.) Curved Dampers |
|---|---|---|
| 900 | 0.08 | 0.010 |
| 1200 | 0.10 | 0.017 |
| 1400 | 0.17 | 0.024 |
| 1600 | 0.26 | 0.031 |
| 1800 | 0.33 | 0.039 |
| 2000 | 0.34 | 0.048 |
| 2200 | 0.36 | 0.059 |
| 2400 | 0.40 | 0.070 |
| 2600 | 0.44 | 0.082 |

Figure 5:
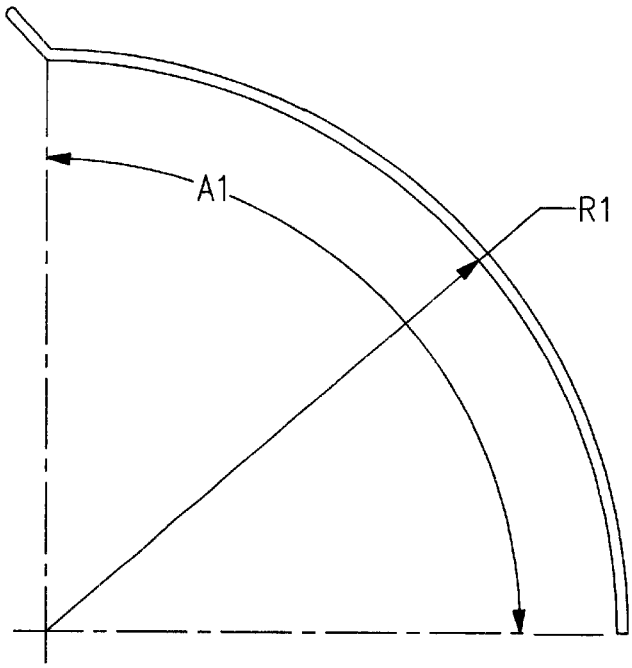
FIG. 5 is a cross-section view of the curved damper.

The data in FIG. 6 and the above table are based upon the curved return air dampers 66 having a radius R1 of 3.0 inches and being fully open. FIG. 5 shows a cross section vie of the curved return air damper 62 having a radius R1 and an arc length A1. The shape of the curved return air dampers 62 of the present invention allow the economizer 50 to mix return air without side air while incurring a significantly low pressure drop across the curved return air dampers 62. When used in connection with commercial buildings, the economizer 50 of the present invention would significantly reduce energy consumption associated with the operation of the air handing system 58 which results in significant cost saving to the customer.

The economizer 50 further comprises a motor unit 96 engaged with and adapted to modulate the curved return air dampers 62 and the straight outside air dampers 66 as instructed by a control unit 98. An air handling system control unit (not shown) is connected to the control unit 98 along a line 100.

Figure 7:
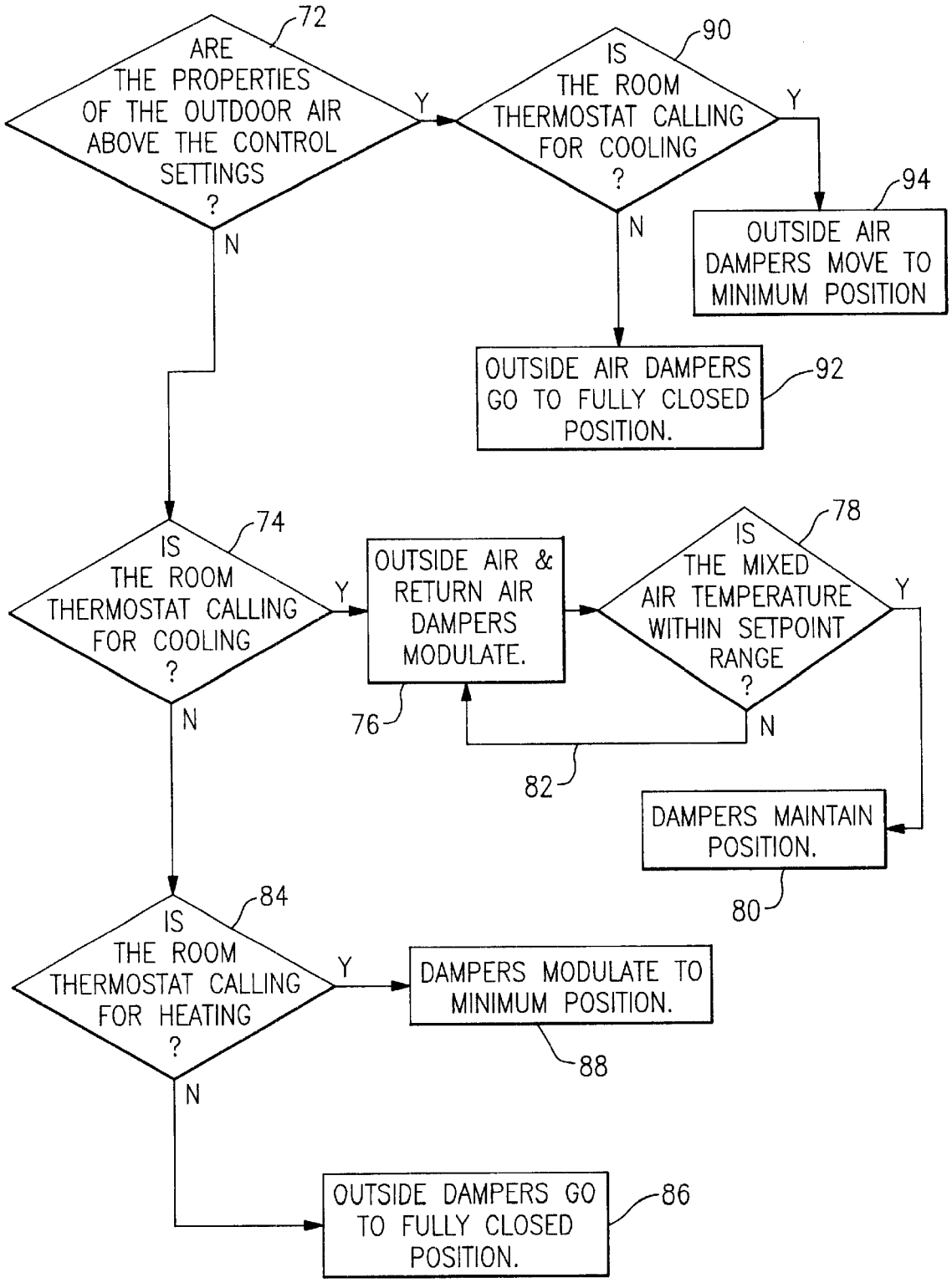
FIG. 7 is a high level flow chart showing the operation of the present invention.

Referring to FIG. 7, wherein a high level flow chart shows the general operation of the economizer 50 of the present invention within the Off Mode, Idle Mode and Operational Mode. As indicated by decisional block 72, the control unit 98 operates to sense whether the properties of the outside air are above or below the control settings. If the properties of the outside air are below the control setting, control is passed to decisional block 74.

As indicated by decisional block 74, the control unit 98 operates to sense whether the thermostat is calling for cooling. If the thermostat is calling for cooling, control is passed to operational block 76.

As indicated by operational block 76, the control unit 98 operates to modulate the straight outside air dampers 66 and the curved return air dampers 62 toward a set point range. Control is then passed to a decisional block 78.

As indicated by decisional block 78, the control unit 98 operates to sense whether the air in the mixing air chamber 56 is within the set point range. If the air in the mixing chamber 56 is within the set point range control passed to decisional block 80 where the curved return air dampers 62 and the straight outside sir dampers 66 remain in position. If the air in the mixing chamber 56 is not within the set point range control is returned to operational block 76 where the straight outside air dampers 66 and the curved return air dampers 62 are modulated toward a set point range (the "Operational Mode"). The Operational Mode may include flow rates from twenty percent (20%) to eighty percent (80%) of return air and/or outside air.

Returning to decisional block 74, if the thermostat is not calling for cooling, control is passed to a decisional block 84. As indicated by decisional block 84 the control unit 98 operates to sense whether the thermostat is calling for heating. If the thermostat is not calling for heating, control is passed to operational block 86 where the straight outside dampers 66 are completely closed and the curved dampers 62 are completely open (the "Off Mode). If the thermostat is calling for heating, control is passed to operational block 88 where the straight outside air dampers 66 and the curved return air dampers 62 are modulated in the Operational Mode as heretofore described.

Returning to decisional block 72, if the properties of the outside air are higher than the control settings, control is passed to decisional block 90. As indicated by decisional block 90, the control unit 98 operates to sense whether the thermostat is calling for heating. If the thermostat is not calling for cooling, control is passed to operational block 92 where the straight outside dampers 66 are completely closed and the curved return air dampers 62 are completely open. If the thermostat is not calling for cooling, control is passed to operational block 94 where the straight outside air dampers 66 are moved to a minimum position.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed is:

1. An economizer for use within a packaged air conditioning unit having a limited overall available static pressure to deliver a controlled ratio of outside air to return air at different operating conditions, the economizer comprising:

(a) an air chamber;

(b) a return air duct in communication with said air chamber;

(c) a plurality of curved return air dampers disposed within said return air duct and moveable from an open position to a closed position to control the flow of the return air to said air chamber;

(d) an outside air duct in communication with said air chamber;

(e) a plurality of dampers moveable from an open position to a closed position to control the flow of the outside air to said air chamber; and (f) a control unit adapted to control movement of said curved return air dampers and said outside air damper to deliver a controlled ratio of the outside air to the return air at different operating conditions, during operation of the economizer a significantly low pressure drop occurs across said curved return air dampers.

2. The system of claim 1, wherein said curved dampers have a radius of about 3.0 inches.

3. The system of claim 1, wherein said curved dampers have a radius between 1.0 and 2.0 inches.

4. The system of claim 1, wherein said curved dampers can be rotated ninety degrees.

* * * * *